US008519994B2

(12) United States Patent
Chiu et al.

(10) Patent No.: US 8,519,994 B2
(45) Date of Patent: Aug. 27, 2013

(54) ELECTROPHORETIC DISPLAY AND METHOD OF DRIVING THE SAME

(75) Inventors: Chung-Hsiang Chiu, Hsin-Chu (TW); Hsiang-Lin Lin, Hsin-Chu (TW); Chung-Yi Chang, Hsin-Chu (TW); Sheng-Wen Huang, Hsin-Chu (TW); Chih-Jen Hu, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 319 days.

(21) Appl. No.: 12/861,851

(22) Filed: Aug. 24, 2010

(65) Prior Publication Data

US 2011/0216055 A1 Sep. 8, 2011

(30) Foreign Application Priority Data

Mar. 8, 2010 (TW) ..... 99106599 A

(51) Int. Cl.
*G09G 5/00* (2006.01)
*G09G 3/36* (2006.01)

(52) U.S. Cl.
USPC ..... 345/212; 345/87; 345/619

(58) Field of Classification Search
USPC ..... 345/214, 212, 619, 107, 87, 209, 345/96
See application file for complete search history.

(56) References Cited

U.S. PATENT DOCUMENTS

| | | | | |
|---|---|---|---|---|
| 2005/0041004 | A1 * | 2/2005 | Gates et al. | 345/87 |
| 2007/0091117 | A1 * | 4/2007 | Zhou et al. | 345/619 |
| 2007/0182704 | A1 | 8/2007 | Hiramatsu | |
| 2008/0024482 | A1 * | 1/2008 | Gates et al. | 345/214 |
| 2009/0322660 | A1 * | 12/2009 | Chung et al. | 345/87 |

OTHER PUBLICATIONS

Notice of Allowance mailed on Apr. 26, 2013 for the Taiwan application No. 099106599, filing date Mar. 8, 2010, p. 1-4.

* cited by examiner

*Primary Examiner* — James Wozniak
*Assistant Examiner* — Kuo Woo
(74) *Attorney, Agent, or Firm* — Winston Hsu; Scott Margo

(57) ABSTRACT

A method of driving an electrophoretic display is set forth for avoiding image-edge residual while sequentially displaying a first frame and a second frame. During the time of displaying the first frame, set a common voltage to be a first voltage, apply a second voltage different from the first voltage to a first pixel for writing a first data signal into the first pixel, and apply the first voltage to a second pixel adjacent to the first pixel for retaining a second data signal of the second pixel, which is different from the first data signal. During the time of displaying the second frame, set the common voltage to be the second voltage, apply the first voltage to the first pixel for writing the second data signal into the first pixel, and apply the first voltage to the second pixel for retaining the second data signal of the second pixel.

11 Claims, 8 Drawing Sheets

ELECTROPHORETIC DISPLAY AND METHOD OF DRIVING THE SAME

BACKGROUND OF THE INVENTION

1. Field of the Invention

The present invention relates to an electrophoretic display and a method of driving the same, and more particularly, to an electrophoretic display capable of displaying frames without image-edge residual and a method of driving the same.

2. Description of the Prior Art

Because flat panel displays (FPDs) have advantages of thin appearance, low power consumption, and low radiation, various kinds of flat panel displays have been developed and widely applied in a variety of electronic products such as computer monitors, mobile phones, personal digital assistants (PDAs), or flat panel televisions. Among them, electrophoretic displays (EPDs), also known as electronic papers, have gained more and more attention due to further advantages of thinner feature, flexible body, and easy-to-carry property. In general, the electrophoretic display comprises a gate driving circuit, a data driving circuit and plural pixels. The gate driving circuit is employed to provide a plurality of gate signals. The data driving circuit is employed to provide a plurality of data signals. Each of the pixels includes a data switch, an electrophoretic medium and plural charged particles suspended in the electrophoretic medium. The color of the charged particles is different from that of the electrophoretic medium. The data switch provides a control of writing a corresponding data signal according to a corresponding gate signal, for changing the voltage difference across opposite sides of the electrophoretic medium. And the voltage difference across opposite sides of the electrophoretic medium can be employed to create an electric field for adjusting the position of the charged particles in the electrophoretic medium. Accordingly, the grey level of each pixel can be set according to the suspension depth of the charged particles in the electrophoretic medium.

FIG. 1 is a schematic diagram showing a prior-art method of driving an electrophoretic display. As shown in FIG. 1, during the time of displaying an Nth frame, both the ith pixel and the (i+1) th pixel are employed to display a grey level of black. And the common voltage Vcom and the pixel voltages VDi, VDi+1 are all set to be a positive voltage Vpos for maintaining the grey level of black, i.e. the charged particles of the ith and (i+1) th pixels are retained to suspend in a position nearby the pixel electrodes 101, 102 within the electrophoretic medium 190. During the time of displaying an (N+1) th frame, the common voltage Vcom is switched to a negative voltage Vneg, the ith pixel is employed to display a grey level of white, and the (i+1) th pixel is employed to display the grey level of black. That is, the grey level of the ith pixel is switched from black color to white color while the grey level of the (i+1) th pixel maintains black color. In the meantime, the pixel voltage VDi+1 is switched to the negative voltage Vneg following a change of the common voltage Vcom. In view of that, the charged particles of the (i+1) th pixel are still retained to suspend in the position nearby the pixel electrode 102 within the electrophoretic medium 190. Besides, the pixel voltage VDi retains the positive voltage Vpos, and the electric field, which is created based on the positive voltage Vpos of the pixel electrode 101 and the negative voltage Vneg of the common electrode 103, moves the charged particles of the ith pixel towards a position nearby the common electrode 103 within the electrophoretic medium 190.

During the time of displaying an (N+2) th frame, the common voltage Vcom is switched to the positive voltage Vpos, both the ith pixel and the (i+1) th pixel are employed to display the grey level of black. That is, the grey level of the ith pixel is switched from white color to black color while and the grey level of the (i+1) th pixel maintains black color. In the meantime, the pixel voltage VDi+1 is switched to the positive voltage Vpos following a change of the common voltage Vcom. In view of that, the charged particles of the (i+1) th pixel are still retained to suspend in the position nearby the pixel electrode 102 within the electrophoretic medium 190. Besides, the pixel voltage VDi is switched to the negative voltage Vneg, and the electric field, which is created based on the negative voltage Vneg of the pixel electrode 101 and the positive voltage Vpos of the common electrode 103, moves the charged particles of the ith pixel towards the position nearby the pixel electrode 101 within the electrophoretic medium 190. It is noted that, in the display setting process of the (N+2) th frame, the electric field created around the edge between the pixel electrode 101 and the pixel electrode 102 is dispersed significantly due to the positive voltage Vpos of the pixel electrode 102. For that reason, in the process of changing the grey level of the ith pixel from white color to black color, some charged particles 199 of the ith pixel, which are suspended in a position close to the edge between the ith and (i+1) th pixels, are actually not moved towards the position nearby the pixel electrode 101, resulting in an image-edge residual phenomenon and degrading the display quality of the (N+2) th frame.

FIG. 2 is a schematic diagram showing another prior-art method of driving an electrophoretic display. As shown in FIG. 2, during the time of displaying an Nth frame, both the ith pixel and the (i+1) th pixel are employed to display a grey level of white. And the common voltage Vcom and the pixel voltages VDi, VDi+1 are all set to be a negative voltage Vneg for maintaining the grey level of white, i.e. the charged particles of the ith and (i+1) th pixels are retained to suspend in a position nearby the common electrode 103 within the electrophoretic medium 190. During the time of displaying an (N+1) th frame, the common voltage Vcom is switched to a positive voltage Vpos, the ith pixel is employed to display a grey level of black, and the (i+1) th pixel is employed to display the grey level of white. That is, the grey level of the ith pixel is switched from white color to black color while the grey level of the (i+1) th pixel maintains white color. In the meantime, the pixel voltage VDi+1 is switched to the positive voltage Vpos following a change of the common voltage Vcom. In view of that, the charged particles of the (i+1) th pixel are still retained to suspend in the position nearby the common electrode 103 within the electrophoretic medium 190. Besides, the pixel voltage VDi retains the negative voltage Vneg, and the electric field, which is created based on the negative voltage Vneg of the pixel electrode 101 and the positive voltage Vpos of the common electrode 103, moves the charged particles of the ith pixel towards a position nearby the pixel electrode 101 within the electrophoretic medium 190.

During the time of displaying an (N+2) th frame, the common voltage Vcom is switched to the negative voltage Vneg, both the ith pixel and the (i+1) th pixel are employed to display the grey level of white. That is, the grey level of the ith pixel is switched from black color to white color while the grey level of the (i+1) th pixel maintains white color. In the meantime, the pixel voltage VDi+1 is switched to the negative voltage Vneg following a change of the common voltage Vcom. In view of that, the charged particles of the (i+1) th pixel are still retained to suspend in the position nearby the common electrode 103 within the electrophoretic medium 190. Besides, the pixel voltage VDi is switched to the positive voltage Vpos, and the electric field, which is created based on the positive voltage Vpos of the pixel electrode 101 and the negative voltage Vneg of the common electrode 103, moves the charged particles of the ith pixel towards the position nearby the common electrode 103 within the electrophoretic medium 190. Similarly, in the display setting process of the (N+2) th frame, the electric field created around the edge between the pixel electrode 101 and the pixel electrode 102 is dispersed significantly due to the negative voltage Vneg of the pixel electrode 102. For that reason, in the process of changing the grey level of the ith pixel from black color to white color, some charged particles 299 of the ith pixel, which are suspended in a position close to the edge between the ith and (i+1) th pixels, are actually not moved towards the position nearby the common electrode 103, resulting in an image-edge residual phenomenon and degrading the display quality of the (N+2) th frame.

SUMMARY OF THE INVENTION

In accordance with one embodiment of the present invention, a method of driving an electrophoretic having a first pixel and a second pixel adjacent to each other is set forth for enhancing display quality by avoiding image-edge residual. The method comprises setting a common voltage to be a first voltage during a first frame time; applying a second voltage different from the first voltage to the first pixel for writing a first data signal into the first pixel during the first frame time; applying the first voltage to the second pixel for retaining a second data signal of the second pixel during the first frame time, the second data signal being different from the first data signal; setting the common voltage to be the second voltage during a second frame time following the first frame time; applying the first voltage to the first pixel for writing the second data signal into the first pixel during the second frame time; and applying the first voltage to the second pixel for retaining the second data signal of the second pixel during the second frame time.

In accordance with another embodiment of the present invention, a method of driving an electrophoretic having a first pixel and a second pixel adjacent to each other is set forth for enhancing display quality by avoiding image-edge residual. The method comprises setting a common voltage to be a first voltage during a first frame time; writing a first data signal into the first pixel during the first frame time; applying a first driving voltage to the second pixel for writing a second data signal into the second pixel during the first frame time; determining whether the second data signal is different from the first data signal; setting the common voltage to be a second voltage different from the first voltage during a second frame time following the first frame time; writing the second data signal into the first pixel during the second frame time; and applying a second driving voltage to the second pixel for retaining the second data signal of the second pixel during the second frame time. While performing the method of driving the electrophoretic, if the second data signal is different from the first data signal, the second driving voltage is substantially identical to the first driving voltage.

The present invention further provides an electrophoretic display capable of displaying frames without image-edge residual. The electrophoretic display comprises a data driving unit and a pixel array unit. The data driving unit is utilized for sequentially receiving plural first data signals corresponding to a first frame and plural second data signals corresponding to a second frame following the first frame. The data driving unit is further utilized for sequentially providing plural first driving voltages to display the first frame and plural second driving voltages to display the second frame based on the first and second data signals. The data driving unit comprises a grey-level edge analysis unit and a voltage providing unit. The grey-level edge analysis unit is put in use for analyzing the first data signals to determine whether a first pixel and a second pixel adjacent to the first pixel have different data signals in the first frame, and for analyzing the second data signals to determine whether the first pixel and the second pixel have one and the same data signal in the second frame. The voltage providing unit, electrically connected to the grey-level edge analysis unit, is put in use for providing the first driving voltages corresponding to the first data signals, and for providing the second driving voltages according to the second data signals together with an analysis result of the grey-level edge analysis unit. The pixel array unit, electrically connected to the data driving unit, is utilized for displaying the first frame based on the first driving voltages and a common voltage being set as a first voltage, and for displaying the second frame based on the second driving voltages and the common voltage being set as a second voltage different from the first voltage. The pixel array unit comprises the first pixel and the second pixel. In the operation of the electrophoretic display, if the grey-level edge analysis unit determines that the first and second pixels have different data signals in the first frame and the first and second pixels have one and the same data signal in the second frame, regarding a grey-level maintaining operation over either the first pixel or the second pixel, the voltage providing unit provides a driving voltage for performing the grey-level maintaining operation and the driving voltage is fixed during two successive frame times for sequentially displaying the first frame and the second frame.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the present invention will be described in detail with reference to the accompanying drawings. Here, it is to be noted that the present invention is not limited thereto. Furthermore, the step serial numbers regarding the method of driving an electrophoretic display are not meant thereto limit the operating sequence, and any rearrangement of the operating sequence for achieving same functionality is still within the spirit and scope of the invention.

Figure 1:
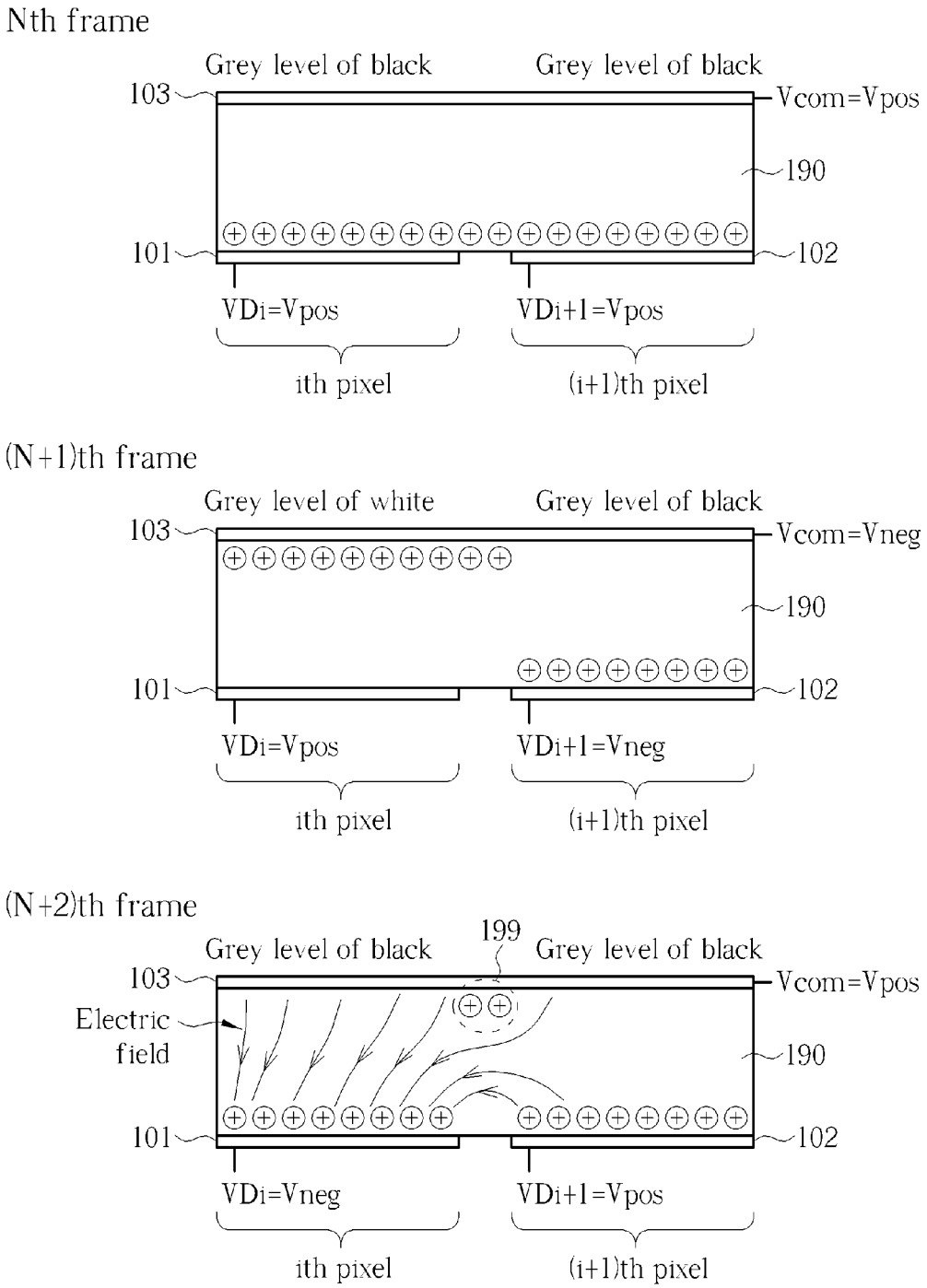
FIG. 1 PRIOR ART
FIG. 1 is a schematic diagram showing a prior-art method of driving an electrophoretic display.
Figure 2:
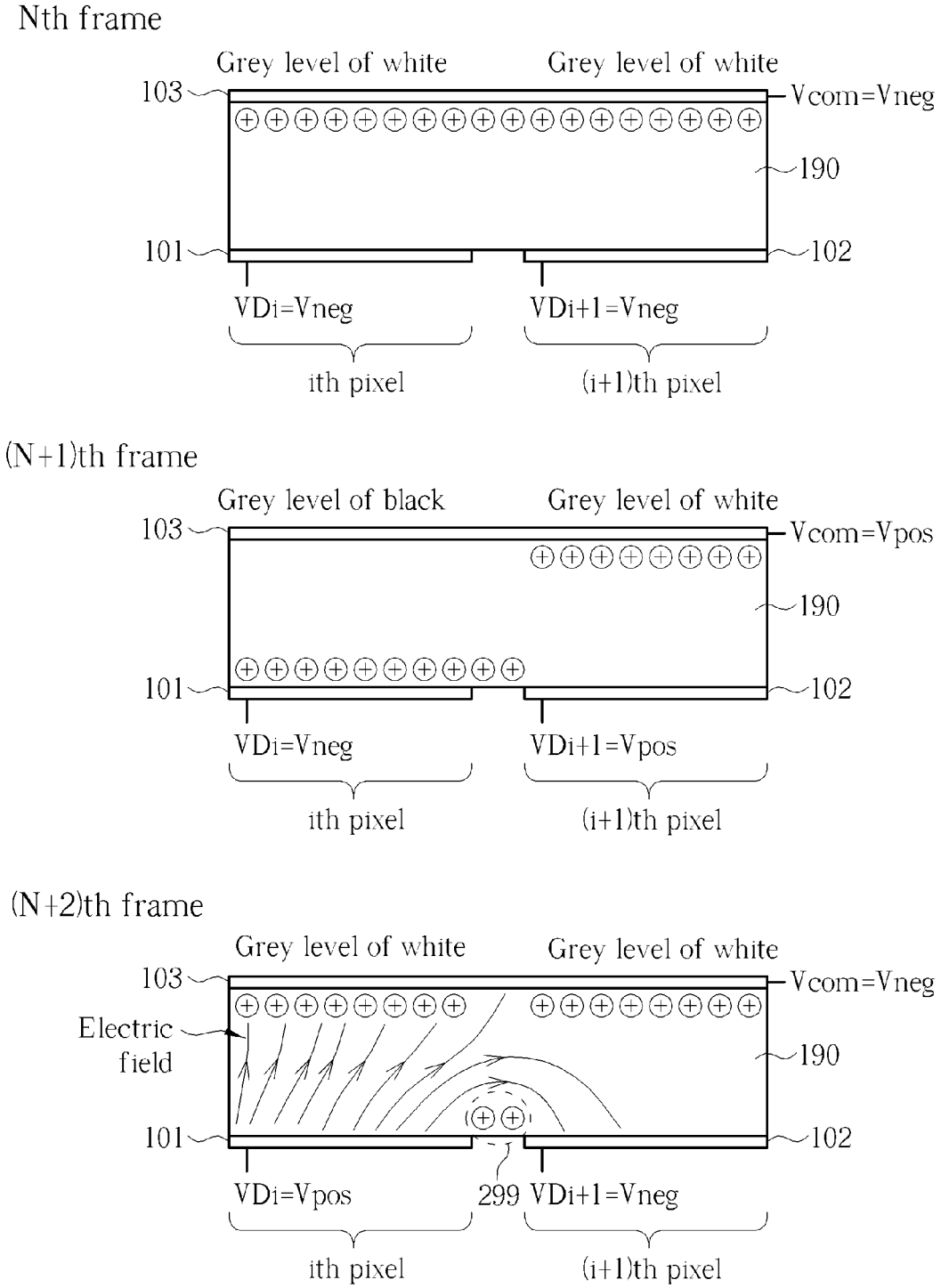
FIG. 2 PRIOR ART
FIG. 2 is a schematic diagram showing another prior-art method of driving an electrophoretic display.
Figure 3:
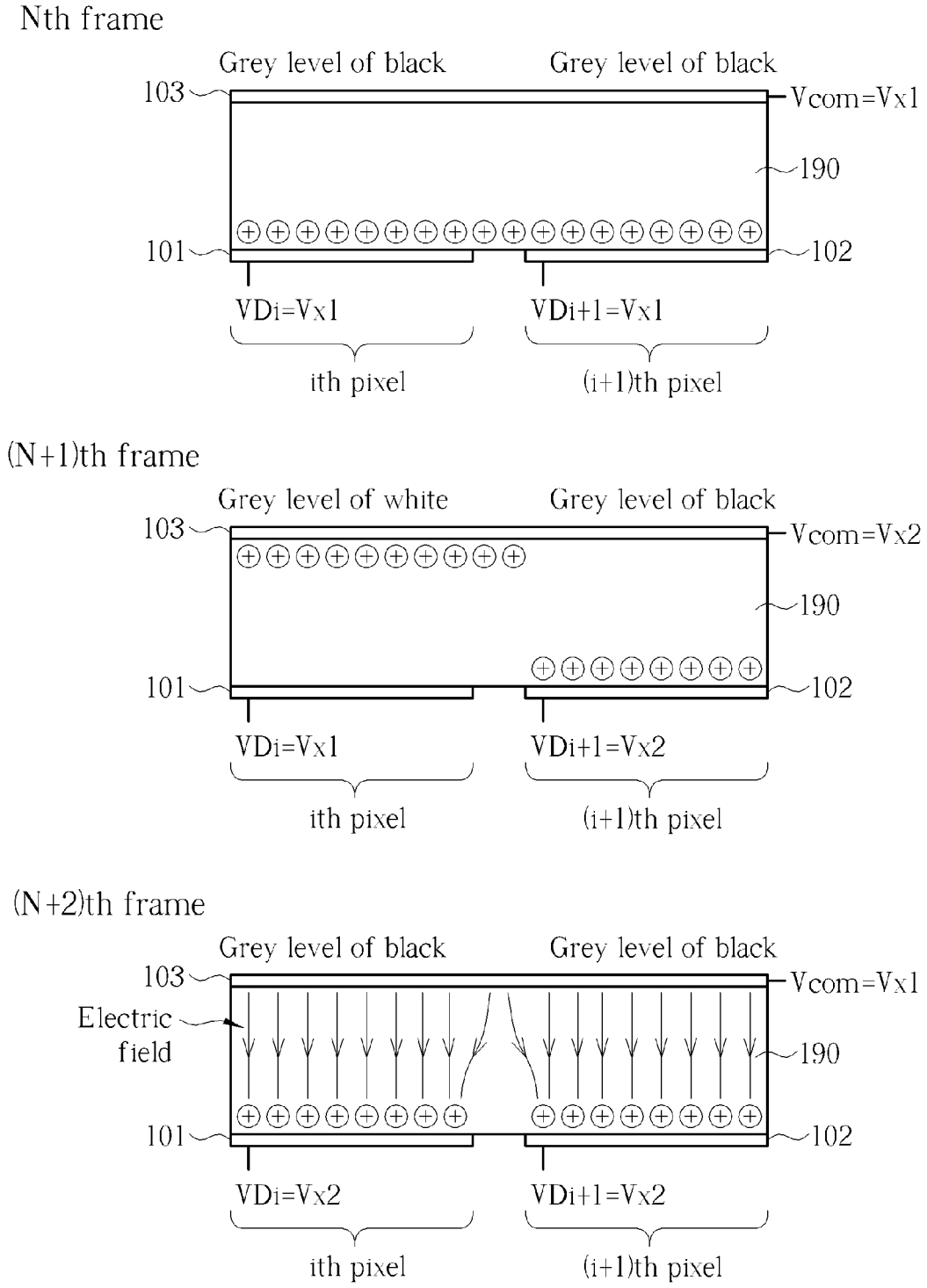
FIG. 3 is a schematic diagram showing a method of driving an electrophoretic display in accordance with a first embodiment of the present invention.

FIG. 3 is a schematic diagram showing a method of driving an electrophoretic display in accordance with a first embodiment of the present invention. As shown in FIG. 3, during the time of displaying an Nth frame, both the ith pixel and the (i+1) th pixel are employed to display a grey level of black. And the common voltage Vcom and the pixel voltages VDi, VDi+1 are all set to be a first voltage Vx1 for maintaining the grey level of black, i.e. the charged particles of the ith and (i+1) th pixels are retained to suspend in a position nearby the pixel electrodes 101, 102 within the electrophoretic medium 190. During the time of displaying an (N+1) th frame, the common voltage Vcom is switched to a second voltage Vx2 different from the first voltage Vx1, the ith pixel is employed to display a grey level of white, and the (i+1) th pixel is employed to display the grey level of black. That is, the grey level of the ith pixel is switched from black color to white color while the grey level of the (i+1) th pixel maintains black color. In the meantime, the pixel voltage VDi+1 is switched to the second voltage Vx2 following a change of the common voltage Vcom. In view of that, the charged particles of the (i+1) th pixel are still retained to suspend in the position nearby the pixel electrode 102 within the electrophoretic medium 190. Besides, the pixel voltage VDi retains the first voltage Vx1, and the electric field, which is created based on the first voltage Vx1 of the pixel electrode 101 and the second voltage Vx2 of the common electrode 103, moves the charged particles of the ith pixel towards a position nearby the common electrode 103 within the electrophoretic medium 190.

During the time of displaying an (N+2) th frame, the common voltage Vcom is switched to the first voltage Vx1, both the ith pixel and the (i+1) th pixel are employed to display the grey level of black. That is, the grey level of the ith pixel is switched from white color to black color while the grey level of the (i+1) th pixel maintains black color. In the meantime, the pixel voltage VDi+1 retains the second voltage Vx2 so that the charged particles of the (i+1) th pixel are still retained to suspend in the position nearby the pixel electrode 102 within the electrophoretic medium 190. In other words, regarding the process of replacing the (N+1) th frame with the (N+2) th frame, the pixel voltage VDi+1 is fixed instead of being switched to the first voltage Vx1 following a change of the common voltage Vcom. Besides, the pixel voltage VDi is switched to the second voltage Vx2, and the electric field, which is created based on the second voltage Vx2 of the pixel electrode 101 and the first voltage Vx1 of the common electrode 103, moves the charged particles of the ith pixel towards the position nearby the pixel electrode 101 within the electrophoretic medium 190.

It is noted that, in the display setting process of the (N+2) th frame, the electric field created between the pixel electrodes 101, 102 and the common electrode 103 is quite uniform because both the pixel voltage VDi and the pixel voltage VDi+1 are set to be the second voltage Vx2. For that reason, the electric field created between the pixel electrodes 101, 102 and the common electrode 103 is able to move all the charged particles of the ith pixel towards the position nearby the pixel electrode 101 within the electrophoretic medium 190 as well as to retain the charged particles of the (i+1) th pixel to suspend in the position nearby the pixel electrode 102 within the electrophoretic medium 190. To sum up, the electric field created around the edge between the pixel electrode 101 and the pixel electrode 102 is not dispersed significantly, and the aforementioned image-edge residual phenomenon can be avoided in that the electric field uniformly created leaves no residual charged particles around pixel edge, for achieving high display quality.

Figure 4:
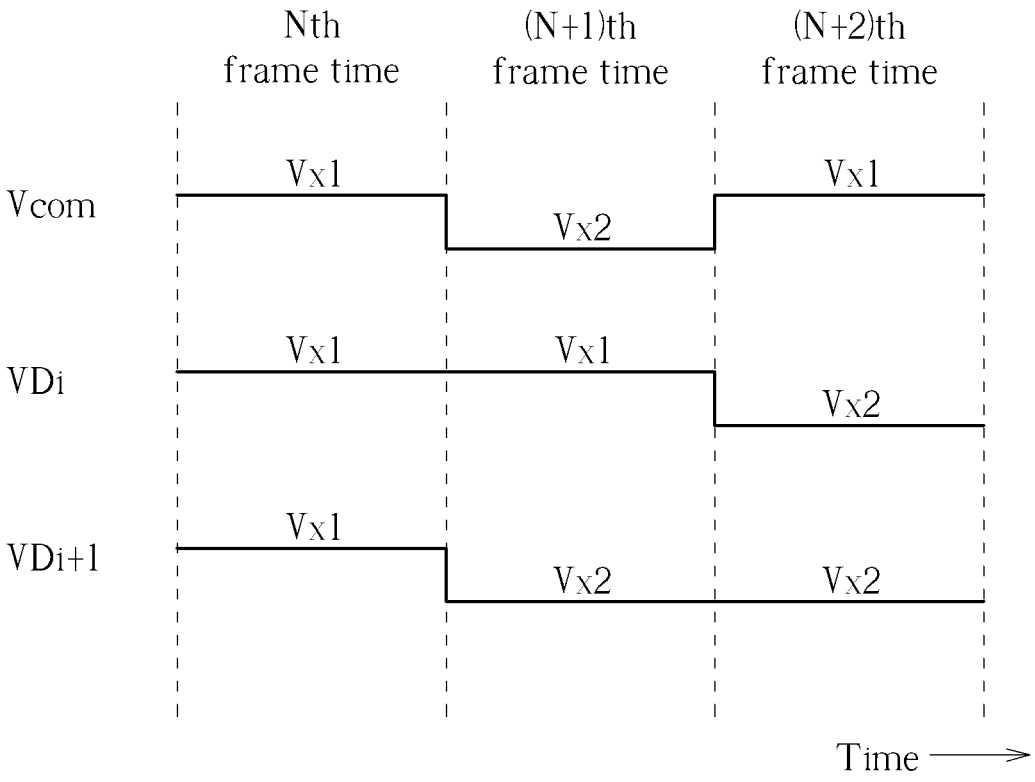
FIG. 4 is a schematic diagram showing related signal waveforms regarding the method of driving an electrophoretic display in accordance with the first embodiment shown in FIG. 3, having time along the abscissa.

FIG. 4 is a schematic diagram showing related signal waveforms regarding the method of driving an electrophoretic display in accordance with the first embodiment shown in FIG. 3, having time along the abscissa. The signal waveforms in FIG. 4, from top to bottom, are the common voltage Vcom, the pixel voltage VDi, and the pixel voltage VDi+1. During the Nth frame time, the common voltage Vcom and the pixel voltages VDi, VDi+1 are all set to be the first voltage Vx1 for maintaining the black color of the ith and (i+1) th pixels. During the (N+1) th frame time, both the common voltage Vcom and the pixel voltage VDi+1 are switched to the second voltage Vx2 lower than the first voltage Vx1, and the pixel voltage VDi retains the first voltage Vx1, for maintaining the black color of the (i+1) th pixel and for switching the grey level of the ith pixel from black color to white color. In one embodiment, the polarity of the first voltage Vx1 is positive and the polarity of the second voltage Vx2 is negative. During the (N+2) th frame time, the common voltage Vcom is switched to the first voltage Vx1, the pixel voltage VDi is switched to the second voltage Vx2, and the pixel voltage VDi+1 retains the second voltage Vx2, for maintaining the black color of the (i+1) th pixel and for switching the grey level of the ith pixel from white color to black color. Therefore, in the process of maintaining the black color of the (i+1) th pixel, the pixel voltage VDi+1 is fixed during two successive frame times for displaying the (N+1) th and (N+2) th frames. In other words, during the process of replacing the (N+1) th frame with the (N+2) th frame, the pixel voltage VDi+1 is fixed instead of being switched to the first voltage Vx1 following a change of the common voltage Vcom, for achieving high display quality without image-edge residual.

Figure 5:
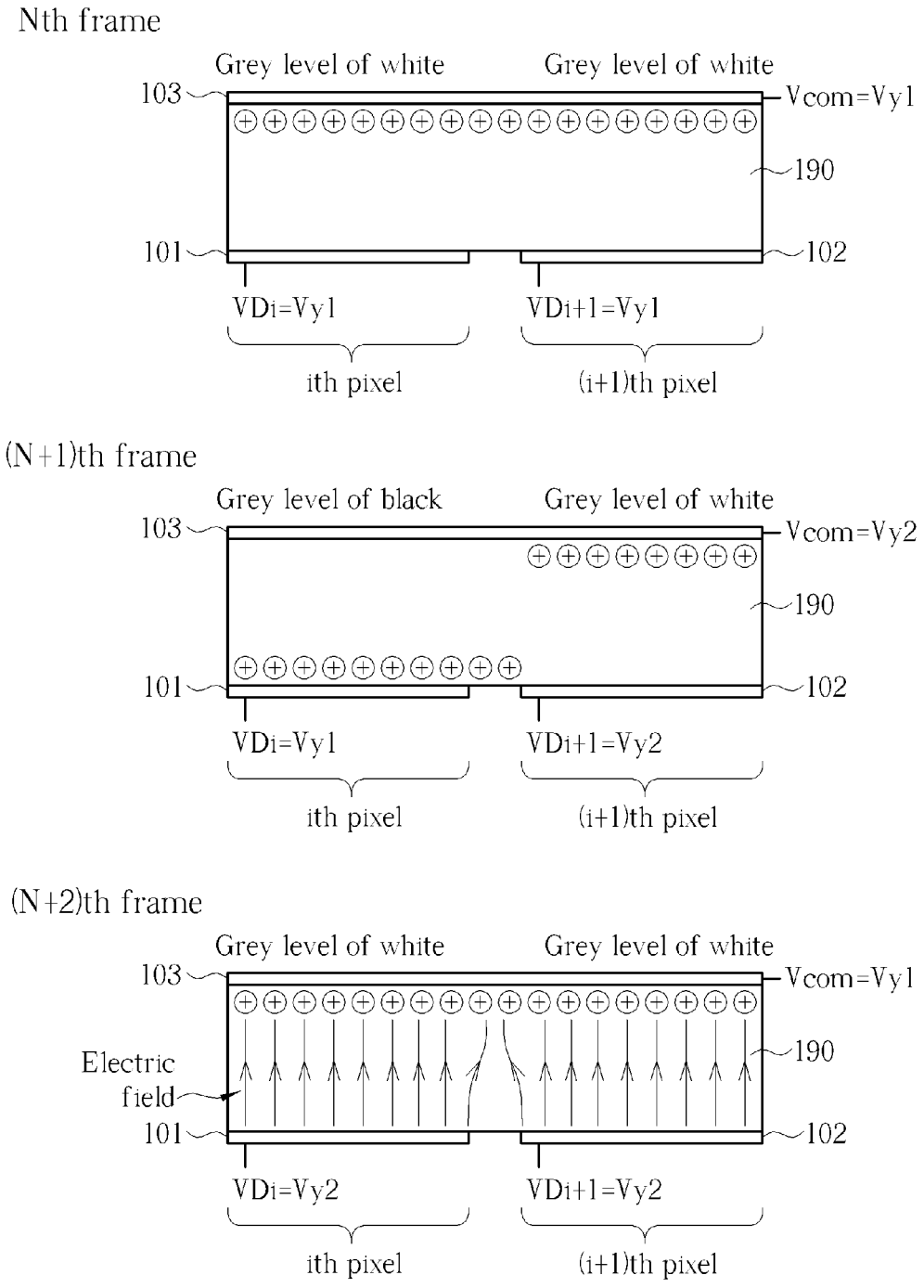
FIG. 5 is a schematic diagram showing a method of driving an electrophoretic display in accordance with a second embodiment of the present invention.

FIG. 5 is a schematic diagram showing a method of driving an electrophoretic display in accordance with a second embodiment of the present invention. As shown in FIG. 5, during the time of displaying an Nth frame, both the ith pixel and the (i+1) th pixel are employed to display a grey level of white. And the common voltage Vcom and the pixel voltages VDi, VDi+1 are all set to be a first voltage Vy1 for maintaining the grey level of white, i.e. the charged particles of the ith and (i+1) th pixels are retained to suspend in a position nearby the common electrodes 103 within the electrophoretic medium 190. During the time of displaying an (N+1) th frame, the common voltage Vcom is switched to a second voltage Vy2 different from the first voltage Vy1, the ith pixel is employed to display a grey level of black, and the (i+1) th pixel is employed to display the grey level of white. That is, the grey level of the ith pixel is switched from white color to black color while the grey level of the (i+1) th pixel maintains white color. In the meantime, the pixel voltage VDi+1 is switched to the second voltage Vy2 following a change of the common voltage Vcom. In view of that, the charged particles of the (i+1) th pixel are still retained to suspend in the position nearby the common electrode 103 within the electrophoretic medium 190. Besides, the pixel voltage VDi retains the first voltage Vy1, and the electric field, which is created based on the first voltage Vy1 of the pixel electrode 101 and the second voltage Vy2 of the common electrode 103, moves the charged particles of the ith pixel towards a position nearby the pixel electrode 101 within the electrophoretic medium 190.

During the time of displaying an (N+2) th frame, the common voltage Vcom is switched to the first voltage Vy1, both the ith pixel and the (i+1) th pixel are employed to display the grey level of white. That is, the grey level of the ith pixel is switched from black color to white color while the grey level of the (i+1) th pixel maintains white color. In the meantime, the pixel voltage VDi+1 retains the second voltage Vy2 so that the charged particles of the (i+1) th pixel are still retained to suspend in the position nearby the common electrode 103 within the electrophoretic medium 190. In other words, regarding the process of replacing the (N+1) th frame with the (N+2) th frame, the pixel voltage VDi+1 is fixed instead of being switched to the first voltage Vy1 following a change of the common voltage Vcom. Besides, the pixel voltage VDi is switched to the second voltage Vy2, and the electric field, which is created based on the second voltage Vy2 of the pixel electrode 101 and the first voltage Vy1 of the common electrode 103, moves the charged particles of the ith pixel towards the position nearby the common electrode 103 within the electrophoretic medium 190.

It is noted that, in the display setting process of the (N+2) th frame, the electric field created between the pixel electrodes 101, 102 and the common electrode 103 is quite uniform because both the pixel voltage VDi and the pixel voltage VDi+1 are set to be the second voltage Vy2. For that reason, the electric field created between the pixel electrodes 101, 102 and the common electrode 103 is able to move all the charged particles of the ith pixel towards the position nearby the common electrode 103 within the electrophoretic medium 190 as well as to retain the charged particles of the (i+1) th pixel to suspend in the position nearby the common electrode 103 within the electrophoretic medium 190. To sum up, the electric field created around the edge between the pixel electrode 101 and the pixel electrode 102 is not dispersed significantly, and the aforementioned image-edge residual phenomenon can be avoided in that the electric field uniformly created leaves no residual charged particles around pixel edge, for achieving high display quality.

Figure 6:
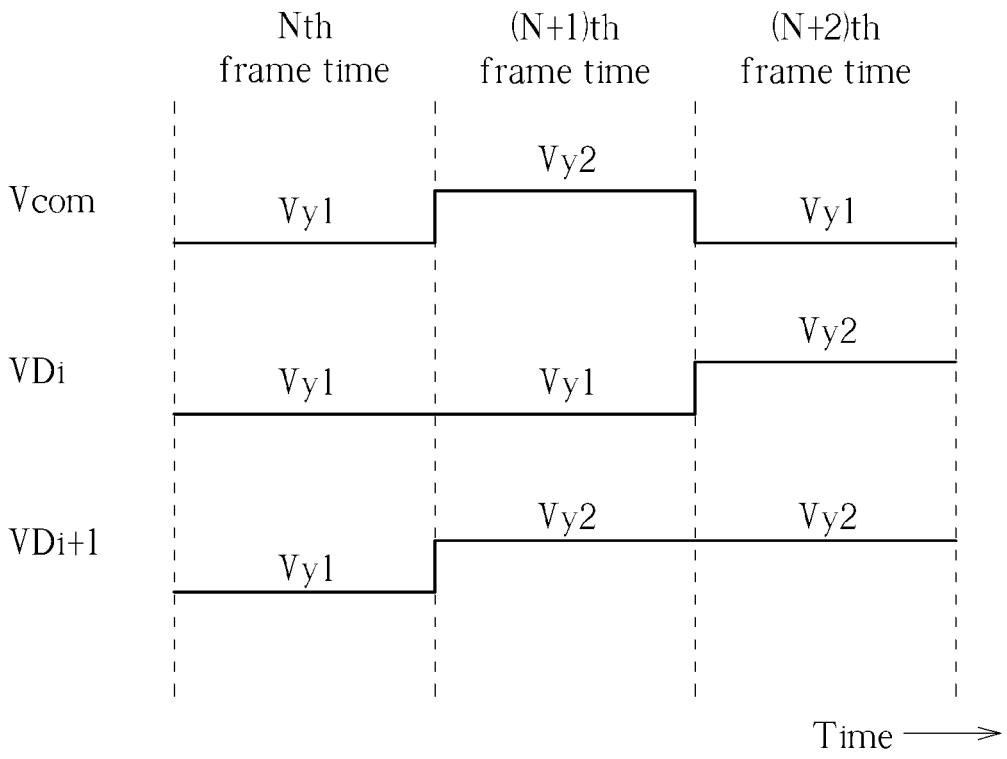
FIG. 6 is a schematic diagram showing related signal waveforms regarding the method of driving an electrophoretic display in accordance with the second embodiment shown in FIG. 5, having time along the abscissa.

FIG. 6 is a schematic diagram showing related signal waveforms regarding the method of driving an electrophoretic display in accordance with the second embodiment shown in FIG. 5, having time along the abscissa. The signal waveforms in FIG. 6, from top to bottom, are the common voltage Vcom, the pixel voltage VDi, and the pixel voltage VDi+1. During the Nth frame time, the common voltage Vcom and the pixel voltages VDi, VDi+1 are all set to be the first voltage Vy1 for maintaining the white color of the ith and (i+1) th pixels. During the (N+1) th frame time, both the common voltage Vcom and the pixel voltage VDi+1 are switched to the second voltage Vy2 greater than the first voltage Vy1, and the pixel voltage VDi retains the first voltage Vy1, for maintaining the white color of the (i+1) th pixel and for switching the grey level of the ith pixel from white color to black color. In one embodiment, the polarity of the first voltage Vy1 is negative and the polarity of the second voltage Vy2 is positive. During the (N+2) th frame time, the common voltage Vcom is switched to the first voltage Vy1, the pixel voltage VDi is switched to the second voltage Vy2, and the pixel voltage VDi+1 retains the second voltage Vy2, for maintaining the white color of the (i+1) th pixel and for switching the grey level of the ith pixel from black color to white color. Therefore, in the process of maintaining the white color of the (i+1) th pixel, the pixel voltage VDi+1 is fixed during two successive frame times for displaying the (N+1) th and (N+2) th frames, for achieving high display quality without image-edge residual.

To sum up, in accordance with the first and second embodiments regarding the method of driving an electrophoretic display, when the ith and (i+1) th pixels of the (N+1) th frame have different grey-level data signals, if two grey-level data signals to be written respectively into the ith and (i+1) th pixels of the (N+2) th frame are one and the same, the pixel voltage VDi+1 is fixed during two successive frame times for displaying the (N+1) th and (N+2) th frames for performing a grey-level maintaining operation over the (i+1) th pixel. That is, in the process of replacing the (N+1) th frame with the (N+2) th frame, the pixel voltage VDi+1 is fixed instead of being switched to a different voltage following a change of the common voltage Vcom, for achieving high display quality without image-edge residual. It is noted that the aforementioned grey-level maintaining operation is not limited to maintain the grey level of white or black.

Figure 7:
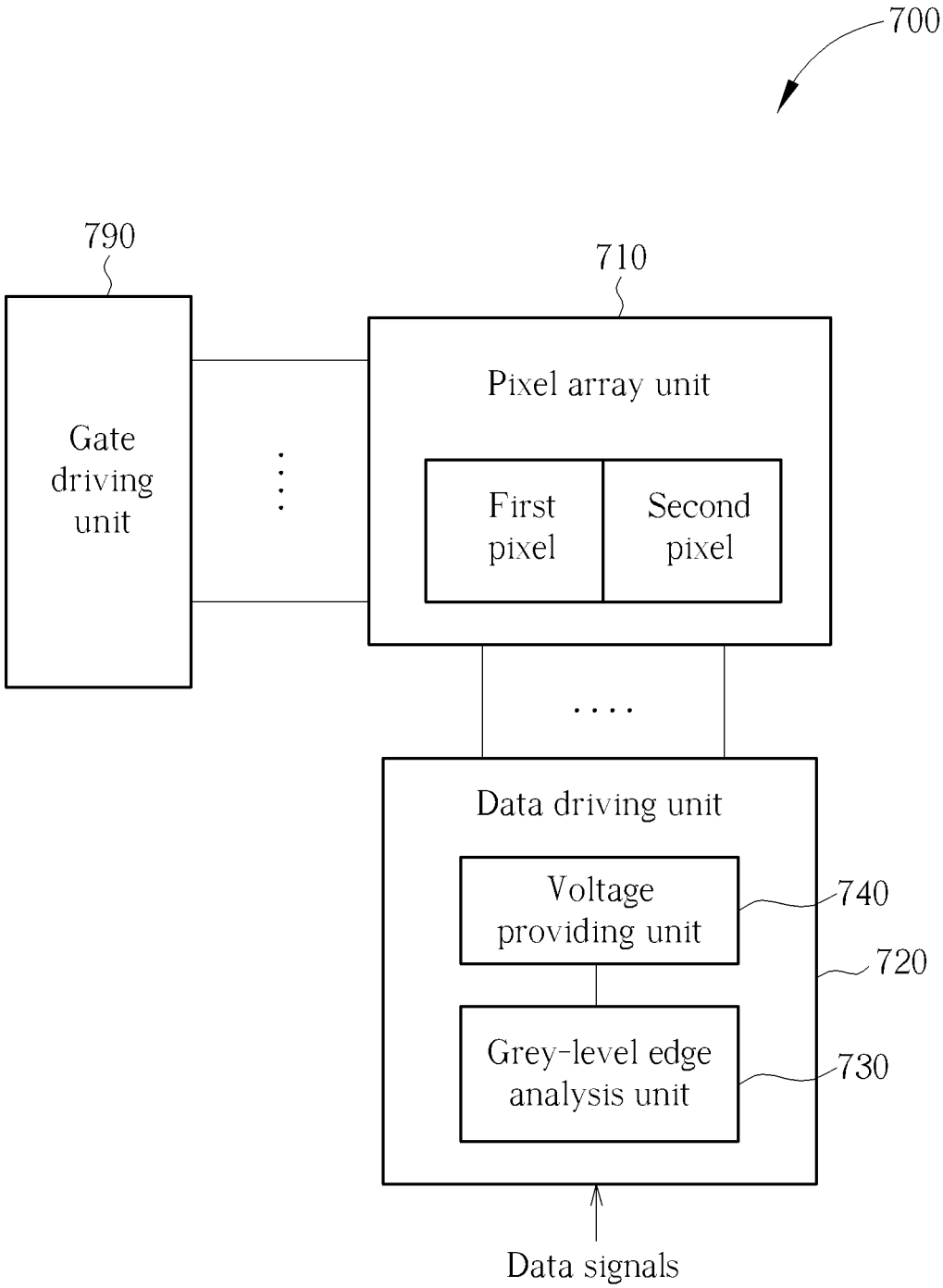
FIG. 7 is a structural diagram schematically showing an electrophoretic display according to the present invention.

FIG. 7 is a structural diagram schematically showing an electrophoretic display according to the present invention. As shown in FIG. 7, the electrophoretic display 700 comprises a pixel array unit 710, a data driving unit 720, and a gate driving unit 790. The data driving unit 720, electrically connected to the pixel array unit 710, is utilized for sequentially receiving plural first data signals corresponding to a first frame and plural second data signals corresponding to a second frame following the first frame, and for sequentially providing plural first driving voltages and plural second driving voltages based on the first and second data signals. The first driving voltages and the second voltages are sequentially furnished to the pixel array unit 710 for sequentially displaying the first frame and the second frame. The gate driving unit 790, electrically connected to the pixel array unit 710, is utilized for providing plural gate signals to the pixel array unit 710. The pixel array unit 710 performs an operation of writing the driving voltages under the control of the gate signals.

The pixel array unit 710 includes a first pixel and a second pixel adjacent to the first pixel. The data driving unit 720 comprises a grey-level edge analysis unit 730 and a voltage providing unit 740. The grey-level edge analysis unit 730 is utilized for analyzing the first data signals to determine whether the first and second pixels have different data signals in the first frame, and for analyzing the second data signals to determine whether the first and second pixels have one and the same data signal in the second frame. The voltage providing unit 740, electrically connected to the grey-level edge analysis unit 730, is utilized for providing the first driving voltages corresponding to the first data signals, and for providing the second driving voltages according to the second data signals together with an analysis result of the grey-level edge analysis unit 730. The pixel array unit 710 is employed to display the first frame based on the first driving voltages and a common voltage being set as a first voltage, and to display the second frame based on the second driving voltages and the common voltage being set as a second voltage different from the first voltage. The common voltage can be provided by the data driving unit 720 or by a common voltage generator (not shown).

In a grey-level maintaining operation over either the first or second pixel of the electrophoretic display 700, if the grey-level edge analysis unit 730 determines that the first and second pixels have different data signals in the first frame and the first and second pixels have one and the same data signal in the second frame, the driving voltage which is provided by the voltage providing unit 740 for performing the grey-level maintaining operation is fixed during two successive frame times for sequentially displaying the first and second frames, for avoiding an occurrence of image-edge residual so as to enhance display quality.

Figure 8:
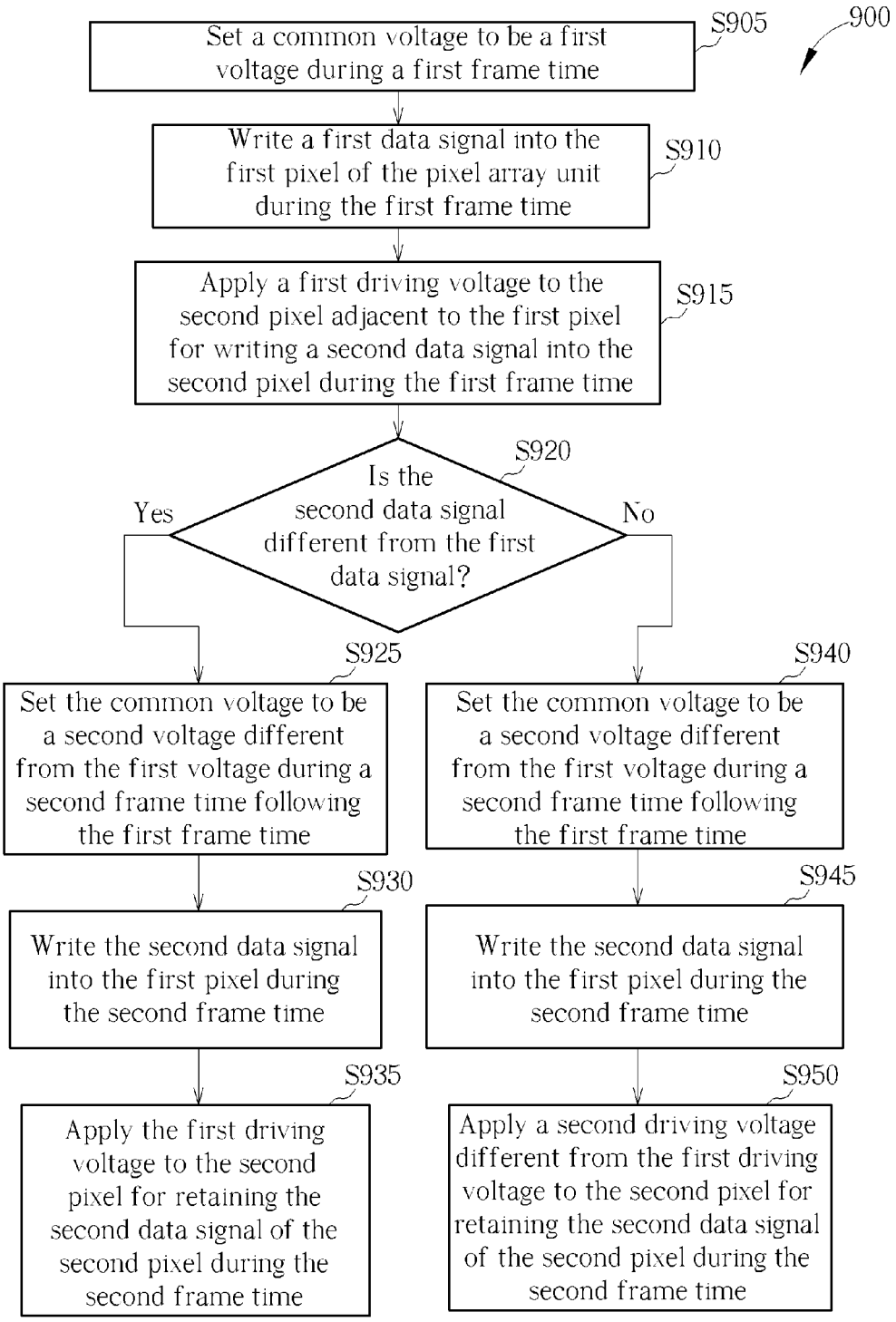
FIG. 8 is a flowchart depicting a method of driving the electrophoretic display shown in FIG. 7 according to the present invention.

FIG. 8 is a flowchart depicting a method of driving the electrophoretic display shown in FIG. 7 according to the present invention. The flow 900 set forth in FIG. 8 is implemented based on the aforementioned first and second embodiments regarding the method of driving an electrophoretic display shown in FIGS. 3-6. The method of driving the electrophoretic display 700 illustrated in the flow 900 comprises the following steps:

Step S905: Set a common voltage to be a first voltage during a first frame time.

Step S910: The data driving unit writes a first data signal into the first pixel of the pixel array unit during the first frame time.

Step S915: The data driving unit applies a first driving voltage to the second pixel adjacent to the first pixel for writing a second data signal into the second pixel during the first frame time.

Step S920: The grey-level edge analysis unit determines whether the second data signal is different from the first data signal. If the second data signal is different from the first data signal, then go to step S925, otherwise go to step S940.

Step S925: Set the common voltage to be a second voltage different from the first voltage during a second frame time following the first frame time.

Step S930: The data driving unit writes the second data signal into the first pixel during the second frame time.

Step S935: The data driving unit applies the first driving voltage to the second pixel for retaining the second data signal of the second pixel during the second frame time.

Step S940: Set the common voltage to be a second voltage different from the first voltage during a second frame time following the first frame time.

Step S945: The data driving unit writes the second data signal into the first pixel during the second frame time.

Step S950: The data driving unit applies a second driving voltage different from the first driving voltage to the second pixel for retaining the second data signal of the second pixel during the second frame time.

In the flow 900 illustrating the method of driving the electrophoretic display 700, when the first and second pixels have different data signals during the first frame time, if two data signals to be written respectively into the first and second pixels during the second frame time are one and the same signal, the pixel voltage of the second pixel is fixed during the first and second frame times for performing a grey-level maintaining operation over the second pixel so as to achieve high display quality without image-edge residual. It is noted that the pixel array unit performs an operation of writing the driving voltages to become the pixel voltages under the control of the gate signals, and therefore each pixel voltage is substantially identical to one corresponding driving voltage.

When the first and second pixels have one and the same data signal during the first frame time, if two data signals to be written respectively into the first and second pixels during the second frame time are also the same, the pixel voltage of the second pixel during the first frame time is different from the pixel voltage of the second pixel during the second frame time so as to perform a grey-level maintaining operation over the second pixel. That is, during the process of replacing the first frame with the second frame, the pixel voltage of the second pixel is altered following a change of the common voltage. In one embodiment regarding the operation in which the second data signal is different from the first data signal, the first data signal is corresponding to a grey level of black and the second data signal is corresponding to a grey level of white. In another embodiment regarding the operation in which the second data signal is different from the first data signal, the first data signal is corresponding to a grey level of white and the second data signal is corresponding to a grey level of black. However, the grey-level maintaining operation in the method of driving the electrophoretic display 700 is not limited to maintain the grey level of white or black.

In conclusion, while performing the method of driving an electrophoretic display according to the present invention, if two adjacent pixels have different data signals in a first frame, and the two adjacent pixels have one and the same data signal in a second frame next to the first frame, regarding a grey-level maintaining operation over either of the two adjacent pixels, the driving voltage for performing the grey-level maintaining operation is fixed during two successive frame times for sequentially displaying the first and second frames, for achieving high display quality without image-edge residual.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. A method of driving an electrophoretic display having a first pixel and a second pixel adjacent to each other, wherein a gray level of the first pixel is controlled by a common electrode and a first pixel electrode, and a gray level of the second pixel is controlled by the common electrode and a second pixel electrode, the method comprising:

setting a common voltage applied on the common electrode to be a first voltage during a first frame time;

applying a second voltage different from the first voltage to the first pixel on the first pixel electrode for writing a first data signal into the first pixel during the first frame time;

applying the first voltage to the second pixel on the second pixel electrode for retaining a second data signal of the second pixel during the first frame time, the second data signal being different from the first data signal;

setting the common voltage applied on the common electrode to be the second voltage during a second frame time following the first frame time;

applying the first voltage to the first pixel on the first pixel electrode for writing the second data signal into the first pixel during the second frame time; and applying the first voltage to the second pixel on the second pixel electrode for retaining the second data signal of the second pixel during the second frame time.

2. The method of claim 1, wherein the first voltage and the second voltage have opposite voltage polarities.

3. The method of claim 1, further comprising:

providing an electrophoretic medium;

providing a plurality of first charged particles in the electrophoretic medium; and providing a plurality of second charged particles in the electrophoretic medium.

4. The method of claim 3, wherein:

writing the first data signal into the first pixel comprises driving the first charged particles to a position in the electrophoretic medium corresponding to a first grey level based on the first data signal;

writing the second data signal into the first pixel comprises driving the first charged particles to a position in the electrophoretic medium corresponding to a second grey level based on the second data signal; and retaining the second data signal of the second pixel comprises retaining a position of the second charged particles in the electrophoretic medium corresponding to the second grey level based on the second data signal;

wherein the second grey level is different from the first grey level.

5. The method of claim 4, wherein the first grey level is a grey level of black and the second grey level is a grey level of white.

6. The method of claim 4, wherein the first grey level is a grey level of white and the second grey level is a grey level of black.

7. A method of driving an electrophoretic display having a first pixel and a second pixel adjacent to each other, wherein a gray level of the first pixel is controlled by a common electrode and a first pixel electrode, and a gray level of the second pixel is controlled by the common electrode and a second pixel electrode, the method comprising:

setting a common voltage applied on the common electrode to be a first voltage during a first frame time;

writing a first data signal into the first pixel during the first frame time;

applying a first driving voltage to the second pixel on the second pixel electrode for writing a second data signal into the second pixel during the first frame time;

determining whether the second data signal is different from the first data signal;

setting the common voltage applied on the common electrode to be a second voltage different from the first voltage during a second frame time following the first frame time;

writing the second data signal into the first pixel during the second frame time; and applying a second driving voltage to the second pixel on the second pixel electrode for retaining the second data signal of the second pixel during the second frame time;

wherein if the second data signal is different from the first data signal, the second driving voltage is substantially identical to the first driving voltage.

8. The method of claim 7, wherein the second data signal is different from the first data signal comprises that the first data signal is corresponding to a grey level of black and the second data signal is corresponding to a grey level of white.

9. The method of claim 7, wherein the second data signal is different from the first data signal comprises that the first data signal is corresponding to a grey level of white and the second data signal is corresponding to a grey level of black.

10. An electrophoretic display, comprising:

a data driving unit, for sequentially receiving plural first data signals corresponding to a first frame and plural second data signals corresponding to a second frame following the first frame, and for sequentially providing plural first driving voltages to display the first frame and plural second driving voltages to display the second frame based on the first and second data signals, the data driving unit comprising:

a grey-level edge analysis unit, for analyzing the first data signals to determine whether a first pixel and a second pixel adjacent to the first pixel have different data signals in the first frame, and for analyzing the second data signals to determine whether the first pixel and the second pixel have one and the same data signal in the second frame; and a voltage providing unit, electrically connected to the grey-level edge analysis unit, for providing the first driving voltages corresponding to the first data signals, and for providing the second driving voltages according to the second data signals together with an analysis result of the grey-level edge analysis unit; and a pixel array unit, electrically connected to the data driving unit, for displaying the first frame based on the first driving voltages and a common voltage being set as a first voltage applied on a common electrode, and for displaying the second frame based on the second driving voltages and the common voltage being set as a second voltage applied on the common electrode different from the first voltage, the pixel array unit comprising the first pixel and the second pixel, wherein a gray level of the first pixel is controlled by the common electrode and a first pixel electrode, and a gray level of the second pixel is controlled by the common electrode and a second pixel electrode;

wherein regarding a grey-level maintaining operation over either the first pixel or the second pixel, if the grey-level edge analysis unit determines that the first and second pixels have different data signals in the first frame and the first and second pixels have one and the same data signal in the second frame, a driving voltage which is provided by the voltage providing unit and applied on the second electrode for performing the grey-level maintaining operation is fixed during two successive frame times for sequentially displaying the first and second frames.

11. The electrophoretic display of claim 10, further comprising:

a gate driving unit, electrically connected to the pixel array unit, for providing plural gate signals;

wherein the pixel array unit performs an operation of writing the driving voltages according to the gate signals.

* * * * *